United States Patent [19]

Satake et al.

[11] Patent Number: 4,861,749

[45] Date of Patent: Aug. 29, 1989

[54] HEAT-SENSITIVE RECORDING MATERIAL

[75] Inventors: Toshimi Satake; Tomoaki Nagai; Fumio Fujimura, all of Tokyo, Japan

[73] Assignee: Jujo Paper Co., Ltd., Tokyo, Japan

[21] Appl. No.: 211,165

[22] Filed: Jun. 22, 1988

Related U.S. Application Data

[63] Continuation of Ser. No. 916,190, Oct. 7, 1986, abandoned.

[30] Foreign Application Priority Data

Nov. 1, 1985 [JP] Japan ..... 60-246063

[51] Int. Cl.[4] ..... B41M 5/18

[52] U.S. Cl. ..... 503/211; 427/150; 428/913; 428/914; 503/216; 503/217; 503/221; 503/225

[58] Field of Search ..... 427/150–152; 428/913, 914; 503/211, 216, 217, 225, 221

[56] References Cited

FOREIGN PATENT DOCUMENTS

| | | | |
|---|---|---|---|
| 0176196 | 10/1982 | Japan | 346/211 |
| 0063192 | 4/1985 | Japan | 346/211 |
| 0083885 | 5/1985 | Japan | 346/211 |

*Primary Examiner*—Bruce H. Hess
*Attorney, Agent, or Firm*—Koda and Androlia

[57] ABSTRACT

A heat-sensitive recording material comprises a support and a color-developing layer having a particular saturated higher fatty acid iron salt, a particular polyvalent phenolic derivative and a colorless leuco dyestuff.

The heat-sensitive recording material of the present invention provides both a superior image contrast and a high stability of developed image against oily substances and solvents.

6 Claims, No Drawings

HEAT-SENSITIVE RECORDING MATERIAL

This is a continuation of application Ser. No. 916,190, filed Oct. 7, 1986, now abandoned.

BACKGROUND OF THE INVENTION

1. Field of the Invention

The present invention relates to a heat-sensitive recording material which has both a superior image contrast and a high stability of developed image against oily substances and solvents such as alcohols.

2. Prior Art

A heat-sensitive recording sheet that utilizes a heat color-forming reaction occurring between a colorless or pale-colored chromogenic dyestuff and a phenolic material, or an organic acid is disclosed for example, in the Japanese Patent Publication Nos. 4160/1968 and 14039/1970 and in the Japanese Laid-Open Patent Application No. 27736/1973, and is now widely applied for practical use.

In general, a heat-sensitive recording sheet is produced by applying on a support, such as paper, film etc., the coating which is prepared by individually grinding and dispersing a colorless chromogenic dyestuff and a color-developing material into fine particles, mixing the resultant dispersion with each other and then adding thereto binder, filler, sensitizer, slipping agent and other auxiliaries. The coating, when heated, undergoes instantaneously a chemical reaction which forms a color. In this case, various bright colors may be formed depending upon the selection of colorless chromogenic dyestuff.

These heat-sensitive recording sheets have now been finding a wide range of applications, including medical or industrial measurement recording instruments, terminal printers of computer and information communication systems, facsimile equipments, printers of electronic calculators, automatic ticket vending machines, and so on.

In recent years, as the heat-sensitive recording systems are widely used and the applications of such rcording are diversified, high image density is now required for the improvement of the resolution. The heat energy of the thermal head in the recording equipments capable of such high density is more minimized. Therefore, it is required that the heat-sensitive recording sheet has a higher color-forming sensitivity sufficient for producing clear chromogenic record with such small heat energy.

Meanwhile, the heat-sensitive recording sheets are inevitably touched with the hand of man, in view of their function as recording sheets of the information.

As the fingers of the operator are often adhered by solvents such as alcohols etc., or by oily substances such as his hair tonic daily used and oils contained in the sweat on his skin, it may be said that the heat-sensitive recording sheets are most frequently contaminated by such substances. In general, the heat-sensitive recording sheets have insufficient stability against these oily substances and the solvents such as alcohols, acetone etc., so that the density of the developed color image on the contaminated part is often reduced or disappeared. The contaminated white ground causes the phenomenon of discoloration or color forming. Their reasons cannot be sufficiently elucidated yet, but it is supposed that such substances partly dissolve the coloring layer consisting of the fine granular basic colorless dyestuff and organic developer or coloring reactant thereof, or make the coloring layer or coloring reactant thereof unstable.

Also, the developed images disappear, or the coloring reaction through the solvent between dyestuff and color-developing agent, i.e. the color development of the ground color, occurs.

In order to increase these stabilities, there was proposed a method in which a barrier layer is formed on the color-developing layer comprising both a leuco dyestuff and an organic color-developing agent to prevent the contact with such solvents or oily substances. However, this method has disadvantages that a barrier layer with good oil-resistance and solvent-resistance is not obtained and the lowering of the sensitivity occurs.

Besides the heat-sensitive color-developing system in which the above colorless dyestuff is used, a color-developing system under the use of metal compounds is known.

For examples, the Japanese Patent Publication No. 8787/1957 describes the combined use of iron stearate (electron acceptor) with tannic acid or gallic acid, and the Japanese Patent Publication No. 6485/1959 describes the combined use of an electron acceptor such as silver stearate, iron stearate, gold stearate, copper stearate or mercury stearate with an electron donator such as methyl gallate, ethyl gallate, propyl gallate, butyl gallate or dodecyl gallate. Since these heat-sensitive recording sheets are based on a heat-sensitive copying system by means of the heat energy of light, they bring the troubles of accumulated residues and sticking under applying to heat-sensitive recording system which uses the thermal printing heads. In this case, they have as disadvantages a low image density, greenish color, poor brightness of the background, inferior stability against solvents such as alcohols, and the flowing-out of the color-developing layer.

Further, the Japanese Laid-Open Patent Application No. 89193/1984 describes a combination of a color-developing system using a leuco dyestuff and a color-developing agent and of a color-developing system using a metal compound of higher fatty acid ferric salt and polyvalent phenol. However, such combination is disadvantageous in costs, since it requires a protecting layer for hiding colored parts. Further, it has a defect that solvents such as alcohols are penetrated through the pin holes of a protecting layer, resulting in coloring (contamination) caused by a reaction between a leuco dyestuff and a color-developing agent which are present in a color-developing layer.

SUMMARY OF THE INVENTION

It is the object of the present invention to provide a heat-sensitive recording material which has an improved image-contrast without deteriorating solvent and oil resistances, in a heat-sensitive color-developing system using metal compounds.

The above object may be performed by using a color-developing layer comprising a colorless leuco dyestuff and a combination of a saturated higher fatty acid iron salt having 16–35 carbon atoms with a polyvalent phenolic derivative represented by the following general formula (I).

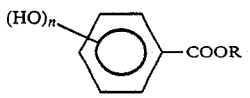

(I)

where R represents an alkyl group having 18–35 carbon atoms, and n represents an integer from 2 to 3.

DETAILED DESCRIPTION OF THE INVENTION

The saturated higher fatty acid iron salts used in the present invention include the following (1) to (4). However, they are not limited to the following compounds.

(1) iron stearate,
(2) iron behenate,
(3) iron montanate, and
(4) acid wax iron salt.

These saturated higher acid iron salts may be used independently as an electron acceptor for heat sensitive recording paper. It is possible to use two or more saturated higher fatty acid iron salts simultaneously.

The polyvalent phenolic derivatives used as electron donator in the present invention are described as follows, but they are not limited to the following compounds, wherein R represents an alkyl group having 18–35 carbon atoms.

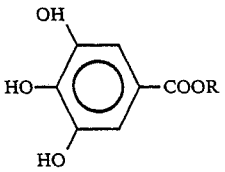

(1)

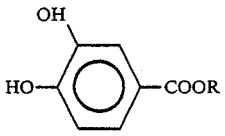

(2)

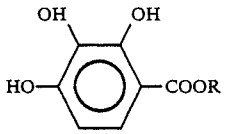

(3)

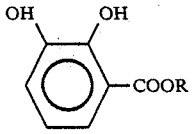

(4)

As Agents in the heat-sensitive recording layer containing these polyvalent phenolic derivatives, there may be used anti-foggants (e.g. fatty acid amide, ethylene bisamide, montan wax), sensitizers (e.g. dibenzzl terephthalate, benzzl p-benzyloxybenzoate, di-p-tolyl carbonate, p-benzylbiphenyl) and stabilizer (e.g. metal salts of phthalic acid monoester, metal salts of p-tertiary-butylbezoate, metal salts of nitrobenzoic acid), wherein the particular effects can be expected for the agents, respectively.

The present invention comprises adding a colorless leuco dyestuff to a color-developing system using a conventional metal compound. Preferably, the colorless leuco dyestuffs include triphenylmethane leuco dyestuff, fluorane leuco dyestuffs, azaphthalide leuco dyestuff and fluorene leuco dyestuff which are as follows:

Triphenylmethane leuco dyes 3,3-bis(p-dimethylaminophenyl)-6-dimethylaminophthalide(crystall violet lactone)

Fluoran leuco dyes 3-diethylamino-6-methyl-7-anilinofluoran
3-(N-ethyl-p-toluidino)-6-methyl-7-anilinofluoran
3-(N-ethyl-N-isoamyl)amino-6-methyl-7-anilinofluoran
3-diethylamino-6-methyl-7-(o,p-dimethylanilino)fluoran
3-pyrolidino-6-methyl-7-anilinofluoran
3-pyperidino-6-methyl-7-anilinofluoran
3-(N-cyclohexyl-N-methylamino)-6-methyl-7-anilinofluoran
3-pyperidino-6-methyl-7-anilinofluoran
3-(N-cyclohexyl-N-methylamino)-6-methyl-7-anilinofluoran
3-diethylamino-7-(m-trifluoromethylanilino)fluoran
3-dibutylamino-7-(o-chloroanilino)fluoran
3-diethylamino-6-methyl-chlorofluoran
3-diethylamino-6-methyl-fluoran
3-cyclohexylamino-6-chlorofluoran
3-diethylamino-7-(o-chloroanilino)fluoran
3-diethylamino-benzo[a]-fluoran Azaphthalide leuco dyes 3-(4-diethylamino-2-ethoxyphenyl-3-(1-ethyl-2-methylindole-3-yl)-4-azaphthalide
3-(4-diethylamino-2-ethoxyphenyl)-3-(1-ethyl-2-methyl-indole-3-yl)-7-azaphthalide
3-(4-diethylamino-2-ethoxyphenyl)-3-(1-octyl-2-methyl-indole-3-yl)-4-azaphthalide
3-(4-N-cyclohexyl-N-methylamino-2-methoxyphenyl)-3-(1-ethyl-2-methylindole-3-yl)-4-azaphthalide Fluorene leuco dyes 3,6,6'-tris(dimethylamino)spiro[fluorene-9,3'phthalide]
3,6,6'-tris(diethylamino)spiro[fluorene-9,3'-phthalide]

These dyestuffs may be used alone or in combination. However, when a leuco dyestuff is used in a large amount, the resistance against solvents, such as alcohols, generally tends to deteriorate.

Therefore, the leuco dyestuff is used in an amount of preferably at most 25% by weight, based on the polyvalent phenolic compound. Among these leuco dyestuffs, 3-diethlamino-7-(ochloroanilino)fluorance, and/or 3-(N-ethyl-p-toluidino6-methyl-anilinofluorance are preferred, since they provide only a slightly decreased resistance against solvents, such as alcohols.

As the water-soluble binders of the present invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, cellulose derivatives such as hydroxyethyl cellulose, methyl cellulose, carboxymethyl cellulose, styrene/maleic acid anhydride and the like. These binder may be used alone or in combination, in accordance with their uses and their required performance. The above saturated-higher fatty acid iron salt, the above polyvalent phenol derivative and the above basic colorless dyestuff are ground down to a particle size of less than several microns or smaller by means of a grinder of emulsifier such as a ball mill, attritor, sand grinder, etc. and binder and various additives in accordance with the purpose, are added thereto to prepare coating colors. The additives of this invention are, for example, inorganic or organic fillers such as silica, calcium carbonate, kaolin, calcined kaolin, diatomaceous earth, talc, titanium dioxide, aluminium hydroxide; releasing agent such as metal salts of fatty acids, etc.; slipping agent such as waxes, etc; UV-absorbers such as benzophenone type or triazole type; water-resistance agent such as glyoxal, etc.; dispersant; anti-foamer; etc.

The species and the amount of saturated higher fatty acid iron salt, polvalent phenol derivative, water-soluble binder, and other ingredients are determined depending upon the performance and recording apptitude required for the heat-sensitive recording material, and are not otherwise limited. However, in ordinary cases, it is suitable to use 1–6 parts by weight of polyvalent phenolic derivative, 2–15 parts by weight of filler and 0.2–1.2 parts by weight of leuco dyestuff, based on 1–6 parts by weight of saturated-higher fatty acid iron salt, and to add 0.5–4 parts by weight of a water-soluble binder in total solid content.

(Function)

The heat-sensitive recording material of the present invention in stable in ground color against the solvent such as alcohol. The reason for this is considered as follows. Namely, both of the organic acid iron salt and polyvalent phenolic derivative used in the present invention contain in the molecule thereof a saturated alkyl group having a carbon number of at least 18. Therefore, they are extremely low in dissolution and diffusion rate and saturation solubility to the solvent. Consequently, even in the case of contamination by the solvent, the physico-chemical reaction between organic acid iron salt, leuco dyestuff and polyvalent phenolic derivative does not take place and, therefore, the stability in ground color is never deteriorated.

On the other hand, the heat-sensitive recording substance is thought to be excellent in oil resistance due to the irreversible thermal melting coloring reaction of the organic acid iron salt with the polyvalent phenolic derivative. Namely, the thermal melting coloring reaction takes place to form a stable complex. It is thought that the complex is so stable that the bonding is never cut even with the adhesion of hairdressings or fats and oils, and therefore, colored images are stable.

(EXAMPLES)

The present invention will be described by way of examples hereunder. Throughout the specification the parts are units by weight.

| [Example 1] | |
|---|---|
| Solution A (dispersion of iron salt) | |
| electron acceptor(see Table 1) | 4.0 parts |
| 10% aqueous solution of polyvinyl alcohol | 10.0 parts |
| water | 6.0 parts |
| Solution B (phenolic derivative dispersion) | |
| electron donor(see Table 1) | 4.0 parts |
| 10% aqueous solution of polyvinyl alcohol | 10.0 parts |
| water | 6.0 parts |
| Solution C (leuco dyestuff dispersion) | |
| 3-diethylamino-6-methyl-7-anilinofluoran | 0.8 parts |
| 10% aqueous solution of polyvinyl alcohol | 2.0 parts |
| Water | 1.2 parts |

The solutions A, B and C of the above-mentioned composition were individually ground to a particle size of 3 microns by attritor. Then, the dispersion were mixed in the following portion to prepare a coating color.

| Coating color | |
|---|---|
| Solution A (iron salt dispersion) | 20.0 parts |
| Solution B (phenolic derivative dispersion) | 36.5 parts |
| Solution C (leuco dyestuff dispersion) | 4.0 parts |
| Kaolin day (50% aqueous dispersion) | 12.0 parts |

The coating color was applied on one side of a base paper weighing 50g/m$^2$ at a coating weight of 6.0 g/m$^2$ and as then dried. The resultant paper was treated to a smoothness of 200–600 seconds by a supercalender. In this manner a heat-sensitive recording material was obtained.

| [Comparative Example 1] | |
|---|---|
| Solution A (dispersion of iron salt) | |
| iron stearate | 4.0 part |
| 10% aqueous solution of polyvinyl alcohol | 10.0 parts |
| water | 6.0 parts |
| Solution B (dispersion of phenolic derivative) | |
| stearyl gallate | 4.0 parts |
| 10% aqueous solution of polyvinyl alcohol | 10.0 parts |
| water | 6.0 parts |

The solutions A and B of the above-mentioned composition were individually ground to a particle size of 3 microns by attritor. Then, the dispersions were mixed in the following portion to prepare a coating color.

In the same manner as in Example 1, the above coating color was applied on one side of a base paper, dried and treated by a supercalender, whereby a heat-sensitive recording material was obtained.

| [Comparative Example 2] | |
|---|---|
| Solution A (dispersion of iron salt) | |
| iron stearate | 4.0 parts |
| 10% aqueous solution of polyvinyl alcohol | 10.0 parts |
| water | 6.0 parts |
| Solution B (dispersion of phenolic derivative) | |
| propyl gallate | 4.0 parts |
| 10% aqueous solution of polyvinyl alcohol | 10.0 parts |
| water | 6.0 parts |
| Solution C (dispersion of dyestuff) | |
| 3-dietylamino-6-methyl-7-anilinofluoran (ODB) | 0.8 part |
| 10% aqueous solution of polyvinyl alcohol | 2.0 parts |
| water | 1.2 parts |

The solutions A, B and C were individually ground in the same procedure as in Camperative Example 1. The dispersions were mixed in the same portion as in Example 1 to prepare a coating color. In the same manner as in Example 1, the coating color was applied on one side of a base paper, dried and treated by a supercalender, whereby a heat-sensitive recording material was obtained.

| [Comparative Example 3] | |
|---|---|
| Solution A (dispersion of dyestuff) | |
| 3-(N—cyclohexyl-N—methylanilino)-6-methyl-7-anilinofluoran | 3.0 parts |
| 10% aqueous solution of polyvinyl alcohol | 7.5 parts |
| water | 4.5 parts |
| Solution B (dispersion of color-developing agent) | |
| bisphenol A | 6.0 parts |
| 10% aqueous solution of polyvinyl alcohol | 15.0 parts |
| water | 9.0 parts |
| Solution C (dispersion of iron salt) | |
| ferric stearate | 2.7 parts |
| 10% aqueous solution of polyvinyl alcohol | 6.75 parts |
| water | 4.05 parts |
| Solution D (dispersion of phenolic derivative) | |
| gallic acid | 8.2 parts |
| 10% aqueous solution of polyvinyl alcohol | 20.5 parts |
| water | 12.3 parts |

The solutions A, B, C and D were individually ground in the same procedure as in Examle 1. The dispersions were mixed in the following portion to prepare a coating color.

| Coating Color | |
|---|---|
| Solution A (dispersion of dyestuff) | 15.0 parts |
| Solution B (dispersion of color-developing agent) | 30.0 parts |
| Solution C (dispersion of iron salt) | 13.5 parts |
| Solution D (dispersion of phenolic derivative) | 41.0 parts |
| Kaolin clay (50% aqueous dispersion) | 12.0 parts |

In the same manner as in Example 1, the coating color was applied on one side of a base paper, dried and treated by a supercalender, whereby a heat-sensitive recording material was obtained.

| [Comparative Example 4] | |
|---|---|
| Solution A (dispersion of dyestuff) | |
| 3-(N—ethyl-N—isoamylamino)-6-methyl-7-anilinofluoran(S-205) | 3.0 parts |

-continued

| [Comparative Example 4] | |
|---|---|
| 10% aqueous solution of polyvinyl alcohol | 7.5 parts |
| water | 4.5 parts |
| Solution B (dispersion of color-developing agent) | |
| gallic acid β-phenethyl ester | 6 parts |
| 10% aqueous solution of polyvinyl alcohol | 15 parts |
| water | 9 parts |

The solutions A and B were individually ground in the same procedure as in Comparative Example 4. The dispersions were mixed in the following portion to prepare a coating color.

| | |
|---|---|
| Solution A (dispersion of dyestuff) | 15 parts |
| Solution B (dispersion of color-developing agent) | 30 parts |
| Kaolin clay (50% aqueous dispersion) | 12 parts |

In the same manner as in Example 1, the above coating color was applied on one side of a base paper, dried and tested by a supercalender, whereby a heat-sensitive recording material.

| [Comparative Example 5] | |
|---|---|
| Solution A (dispersion of dyestuff) | |
| 3-diethylamino-6-methyl-7-anilinofluoran | 3 parts |
| 10% aqueous solution of polyvinyl alcohol | 15 parts |
| water | 9 parts |
| Solution B (dispersion of color-developing agent) | |
| stearyl gallate | 6 parts |
| 10% aqueous solution of polyvinyl alcohol | 15 parts |
| water | 9 parts |

The solutions A and B were individually ground to a same particle size as that of Comparative Example 4. The dispersions were mixed with Kaolin clay dispersion in the same portion as in Comparative Example 4. In the same manner as in Comparative Example 4, the coating color was applied on the one side of a base paper, dried and treated by a supercalender, whereby a heat-sensitive recording material was obtained.

The heat-sensitive recording materials obtained in Example and Comparative Examples were tested for the qualities and performance. The test results were shown in Table 1.

TABLE 1

| | | Color-forming materials of metal salt-base | | Color-forming materials of leuco dyestuff base | | Test results | | | |
|---|---|---|---|---|---|---|---|---|---|
| | | Electron acceptor | Electron donor | dyestuff | Color developing agent | Image density | Optical density of background | Solvent resistance (background) | Oil resistance (image) |
| Examples | 1 | Iron stearate | Stearyl gallate | ODB *(20%) | — | 1.11 | 0.09 | 0.09 | 95% |
| | 2 | Iron behenate | Stearyl gallate | ODB *(20%) | — | 1.12 | 0.09 | 0.09 | 96% |
| | 3 | Iron stearate | Behenyl gallate | ODB *(20%) | — | 1.11 | 0.09 | 0.09 | 94% |
| | 1 | Iron stearate | Stearyl gallate | — | | 0.71 | 0.14 | 0.09 | 90% |
| | 2 | Iron stearate | Propyl gallate | ODB *(20%) | — | 0.89 | 0.25 | 0.25 | 91% |
| Comparative Examples | 3 | Iron stearate | Gallic acid | PSD-150 *(36.6%) | Bisphenol A | 0.98 | 0.27 | 1.10 | 82% |
| | 4 | — | — | S-205 | B—phenethyl gallate | 0.87 | 0.10 | 1.12 | 10% |

TABLE 1-continued

| Color-forming materials of metal salt-base | | Color-forming materials of leuco dyestuff base | | Test results | | | |
|---|---|---|---|---|---|---|---|
| Electron acceptor | Electron donor | dyestuff | Color developing agent | Image density | Optical density of background | Solvent resistance (background) | Oil resistance (image) |
| — | — | ODB | Steraryl gallate | 0.92 | 0.09 | 1.08 | 9% |

ODB: 3-diethylamino-6-methyl-7-anilinofluoran
PSD-150: 3-(N—cyclohexyl-N—methylanilino)-6-methyl-7-anilinofluoran
S-205: 3-(N—ethyl-N—isoamylamino)-6-methyl-7-anilinofluoran
*Addition %, based on electron donor Notes:

(1) Dynamic image density

A heat-sensitive recording sheet was recorded in an impressed voltage of 18.03 volt and a pulse width of 3.2 milliseconds by using the thermal facsimile KB4800 manufactured by TOSHIBA CORPORATION, and the optical density of a recorded image was measured by a Macbeth densitometer.

(2) Optical density of background

The optical density of non-recorded part was measured by a Macbeth densitometer.

(3) Solvent resistance

More than 95% ethyl alcohol solution was dropped on non-recorded portion. The optical density was measured by a Macbeth densitometer. (4) A heat-sensitive recording sheet was recorded in an impressed voltage of 18.03 volt and a pulse width of 3.2 milliseconds by using the thermal facsimile KB4800 manufactured by TOSHIBA CORPORATION, and the optical density of a recorded image was measured by a Macbeth densitometer. This density was defined as optical density before oil treatment. Castor oil droplets were dropped on the developed portion printed by the recording and was wiped off. After leaving for 3 days, the optical density was measured by a Macbeth densitometer.

Residual density:

Residual density is calculated by the following equation $$\text{Residual density} = \frac{\text{optical density after oil treatment}}{\text{optical density before oil treatment}} \times 100(\%)$$

(Effect of the invention)

By using as metal salt-system color-developing material a compound with saturated alkyl group having at least 18 carbon atoms, the heat-sensitive recording material of the present invention provides a stable solvent-resistance of the background and a stable oil resistance of the developed image in spite of the addition of leuco dyestuff, and it provides a superior optical density due to the addition of leuco dyestuff.

We claim:

1. A heat-sensitive recording material comprising a support and color-developing layer, wherein said color-developing layer comprises a colorless leuco dyestuff and the combination of a saturated higher fatty acid iron salt having 16–35 carbon atoms with a polyvalent phenolic derivative represented by the following general formula (I):

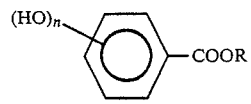

(I)

where R represents an alkyl group having 18–35 carbon atoms, and n represents an integer from 2 to 3, said colorless leuco dyestuff being used in an amount of at most 25% by weight based on said polyvalent phenolic derivative.

2. The heat-sensitive recording material according to claim 1, wherein said polyvalent phenolic derivative represented by the formula (I) is stearyl gallate.

3. The heat-sensitive recording material according to claim 1 wherein said colorless leuco dyestuff is at least one substance selected from the group consisting of triphenyl methane, leuco dyestuffs, fluoran leuco dyestuffs, azaphthalide leuco dyestuffs and fluorene leuco dyestuffs.

4. The heat-sensitive recording material according to claim 3, wherein one of said fluoran leuco dyestuffs is at least one substance selected from the group consisting of 3-diethylamino-7-(o-chloroanilino)fluoran and 3-(N-ethyl-p-toluidino-6-methylanilinofluoran.

5. The heat-sensitive recording material according to claim 1, wherein said color-developing layer comprises 1–6 parts by weight of polyvalent phenolic derivative, 2–15 parts by weight of filler and 0.2–1.2 parts by weight of said leuco dyestuff, based on 1–6 parts by weight of saturated-higher fatty acid iron salt, and 0.5–4 parts by weight of binder in total solid content.

6. The heat-sensitive recording material according to claim 1, wherein said color-developing layer lies on the support.

* * * * *